US009452549B2

(12) United States Patent
Zhang

(10) Patent No.: US 9,452,549 B2
(45) Date of Patent: Sep. 27, 2016

(54) SAPPHIRE WAFER SQUARING MACHINE WITH DOUBLE SWING CUTTER HEADS

(71) Applicant: ECO POWER (WUXI) CO., LTD, Wuxi (CN)

(72) Inventor: Xinzhong Zhang, Wuxi (CN)

(73) Assignee: ECO POWER (WUXI) CO., LTD, Wuxi (CN)

( * ) Notice: Subject to any disclaimer, the term of this patent is extended or adjusted under 35 U.S.C. 154(b) by 99 days.

(21) Appl. No.: 14/336,169

(22) Filed: Jul. 21, 2014

(65) Prior Publication Data

US 2015/0165646 A1 Jun. 18, 2015

(30) Foreign Application Priority Data

Dec. 13, 2013 (CN) ..... 2013 1 0688403

(51) Int. Cl.
*B28D 5/04* (2006.01)
*B28D 5/00* (2006.01)

(52) U.S. Cl.
CPC ..... *B28D 5/045* (2013.01); *B28D 5/0088* (2013.01)

(58) Field of Classification Search
CPC ..... B28D 5/045; B28D 5/0088
See application file for complete search history.

(56) References Cited

U.S. PATENT DOCUMENTS 3,168,893 A * 2/1965 Johnson ..... B28D 5/0088 125/13.01
5,839,424 A * 11/1998 Hauser ..... B28D 5/0088 125/16.01
5,865,162 A * 2/1999 Kambe ..... B23D 57/0053 125/16.02
2012/0048255 A1* 3/2012 Fricker ..... B23D 57/0023 125/16.02
2012/0298091 A1* 11/2012 Hoshiyama ..... B23D 57/0069 125/16.02

FOREIGN PATENT DOCUMENTS

CH 678502 A5 * 9/1991 ..... B23D 57/0023
CH 692489 A5 * 7/2002 ..... B23D 57/0023
CH WO 2010128011 A1 * 11/2010 ..... B23D 57/0023
CH EP 2586554 A1 * 5/2013 ..... B25D 57/0023
JP 07314435 A * 12/1995
JP 3047178 B2 * 5/2000 ..... B23D 57/0023

* cited by examiner

*Primary Examiner* — Joseph J Hail
*Assistant Examiner* — Joel Crandall
(74) *Attorney, Agent, or Firm* — Vierra Magen Marcus LLP

(57) ABSTRACT

The present disclosure provides a sapphire wafer squaring machine with double swing cutter heads, including a frame, an unwinding mechanism, a winding mechanism, two cutter heads placed at an angle of 90° or 180° between each other, an elevator mechanism for the cutter heads and a revolving table. The unwinding mechanism and the winding mechanism are arranged at both ends of the frame, respectively. Two cutter heads are arranged within the frame. The revolving table is rotatable by an angle of 90°, 180°, 270° or 360° and includes a first table and a second table, which are arranged below the two cutter heads, respectively. The cutter heads of the present disclosure may be swung slightly in cutting, so that the contact area between the fixed-diamond wire and the workpiece under cutting is reduced greatly due to the swing compared with the case where the cutter heads are fixed, thus enhancing the pressure per unit area and the cutting efficiency. Further, the cutter heads are arranged above the workpieces, so that it is easy to load and/or unload the workpieces, and the fixed-diamond wires may be fed from top to bottom in cutting process.

5 Claims, 4 Drawing Sheets

SAPPHIRE WAFER SQUARING MACHINE WITH DOUBLE SWING CUTTER HEADS

TECHNICAL FIELD

The present disclosure relates to the technical field of cutting devices dedicated to sapphire, in particular, to a sapphire wafer squaring machine (i.e. a sapphire wafer chamfering machine) with double swing cutter heads.

TECHNICAL BACKGROUND

Sapphire monocrystal has a Moh's hardness of 9, which is only lower than diamond. Therefore, a disk diamond saw-blade used to be adopted to cut the sapphire monocrystal for a long time. For a better surface quality, an inner circle-shaped blade and a wire saw plated with the diamond particles are also used for cutting the sapphire monocrystal. The thickness of the disk blade is at least more than 1 mm, causing serious waste of sapphire monocrystal material in processing. However, the fixed-diamond wire saw causes a saw kerf of only 0.2-0.4 mm, reducing the waste of sapphire monocrystal material.

To produce a square crystal block from a sapphire ingot, it is required to use a squaring machine for squaring. The disclosed square machines in the prior art have the following defects.

1. Since the sapphire monocrystal has a high hardness, its cutting efficiency is still low even though the fixed-diamond wire is used for cutting the sapphire monocrystal. In particular, when the cross-section of a workpiece being cut by the fixed-diamond wire is relatively big, the pressure per unit area applied on the workpiece is relatively small and the cutting efficiency is particularly low. Furthermore, the squaring machines disclosed in the prior art have no swing cutter heads.

2. The square machine disclosed in the prior art includes two layers of fixed-diamond wires, which are arranged one above another, intersect with each other, and are apart from one another by a distance of about 50 mm. When the lower layer of fixed-diamond wires come into contact with the workpiece for cutting, the upper layer of fixed-diamond wires are in an idling state. Similarly, after the lower layer of fixed-diamond wires pass through the workpiece, the upper layer of fixed-diamond wires are still cutting the workpiece, while the lower layer of fixed-diamond wires are in the idling state, causing the waste of cutting time.

3. It is not easy to wire the cutter heads and thus the space between the fixed-diamond wires cannot be very small. Generally, the space between the fixed-diamond wires is more than 50 mm, so the sapphire ingot cannot be cut to be a square with a side length of less than 50 mm.

SUMMARY

For solving the above problems, the present disclosure provides a sapphire wafer squaring machine with double swing cutter heads so as to increase the cutting efficiency of the squaring, reduce wire breakage of the fixed-diamond wires in cutting and make the wiring in the cutter heads easier.

To achieve the above objects, the present disclosure is to provide the following technical solutions.

A sapphire wafer squaring machine with double swing cutter heads includes a frame and further includes an unwinding mechanism, a winding mechanism, two cutter heads placed at an angle of 90° or 180° between each other and an elevator mechanism for the cutter heads and a revolving table.

The unwinding mechanism and the winding mechanism are arranged at both ends of the frame, respectively.

Two cutter heads are arranged within the frame.

The revolving table is rotatable by an angle of 90°, 180°, 270° or 360°, and includes a first table and a second table, which are arranged below two cutter heads, respectively.

Each of the cutter head includes: a sliding plate which is connected with the elevator mechanism for the cutter heads; and a swing frame which is connected with the sliding plate through an arc-shaped rail arranged on the swing frame and a swing shaft arranged at a center of a circle along which the arc-shaped rail run. A servo motor, a first reducer and a gear are arranged coaxially at the sliding plate, and the swing frame is provided with an arc-shaped gear rack which is configured to engage with teeth of the gear.

Two cutting assemblies are arranged at the bottom of the swing frame symmetrically to the swing shaft, and winding assemblies are arranged above the swing frame.

Preferably; the cutting assembly includes a cutting roller and a roller driving motor, and transmission between the cutting roller and the roller driving motor is implemented through driving and driven wheels and a belt.

Preferably, the winding assemblies include two parallel guide-wheel sets respectively arranged above the two cutting assemblies, and the axis of each of the parallel guide-wheel sets is parallel to that of the cutting roller of the corresponding cutting assembly.

Preferably, the elevator mechanism for the cutter heads includes an elevating motor, a second reducer and a screw rod which are arranged from top to bottom successively.

Preferably, a transition guide-wheel set and a tension adjusting mechanism are arranged between the two cutter heads. The transition guide-wheel set and the tension adjusting mechanism may control the tension at the incoming and outgoing fixed-diamond wire ends between the two cutter heads, ensure the two cutter heads have the same cutting efficiency and effectively reduce the probability of wire breakage.

Through the above technical solutions, the present application is to provide a sapphire wafer squaring machine with double swing cutter heads, the cutter heads thereof may be swung slightly in cutting, so that the contact area between the fixed-diamond wire and the workpiece under cutting is reduced greatly due to the swing compared with the case where the cutter heads are fixed, thus enhancing the pressure per unit area and the cutting efficiency. Further, the cutter heads are arranged above the workpieces, so that it is easy to load and/or unload the workpieces, and the fixed-diamond wires may be fed from top to bottom in cutting. The fixed-diamond wires are wound openly (that is, the fixed-diamond wires are uncovered) in the cutter head for the purpose of easy wiring, and the space between the fixed-diamond wires in the cutter heads may be as small as 25 mm so that a minimum square product with a size of 25×25 mm may be obtained by the cutting through the squaring machine. In addition, the fixed-diamond wires of both the cutter heads simultaneously come into contact with the workpieces for cutting, thus there is no idling and waiting time for the cutter heads, thus shortening the cutting time.

DESCRIPTION OF DRAWINGS

The drawings required in the description of the embodiments and the existing technology are briefly described for more clearly illustrating the technical solutions in the embodiments of the present invention or the existing technology.

Figure 1:
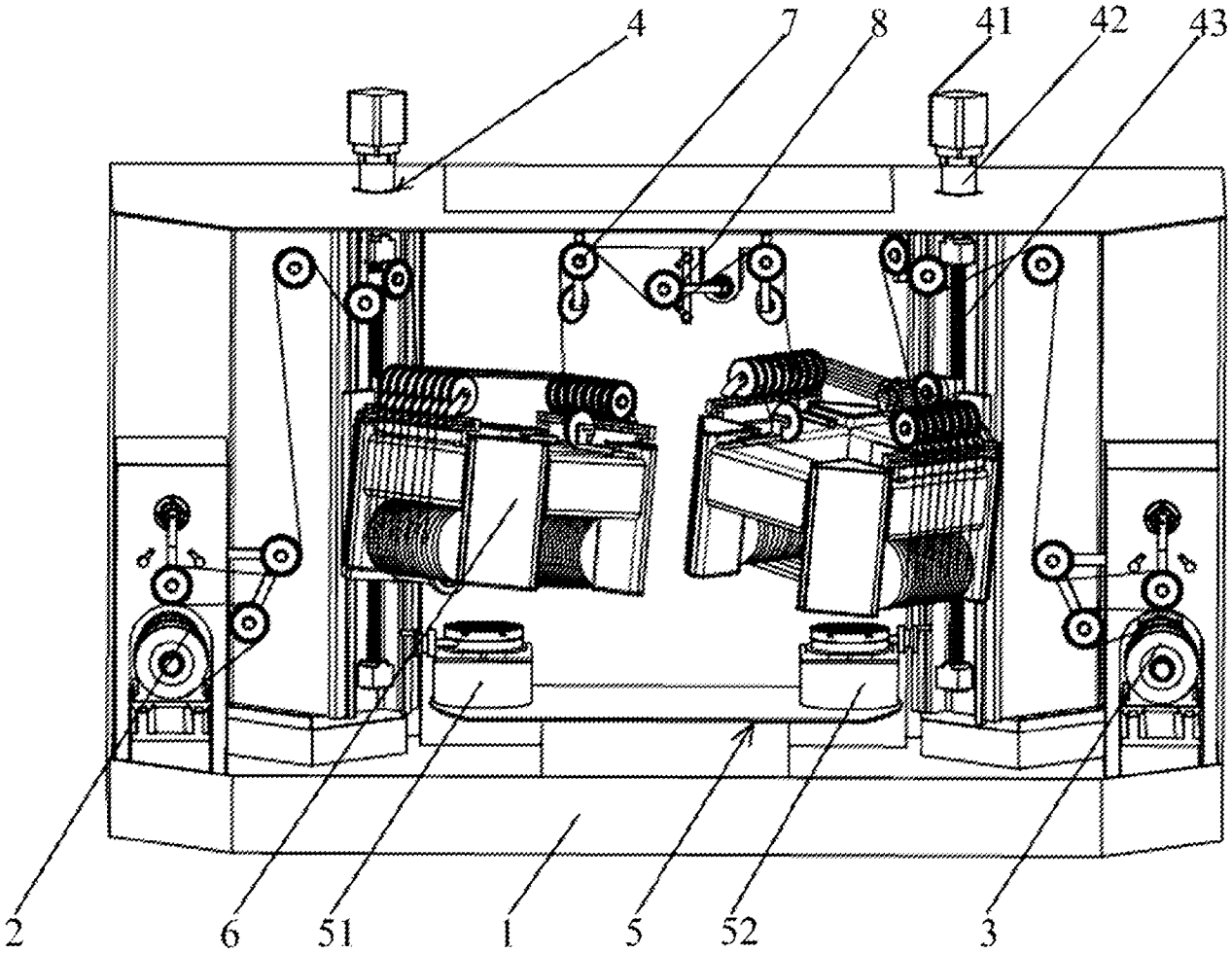
FIG. 1 is a schematic illustration of the whole structure of a sapphire wafer squaring machine with double swing cutter heads according to an embodiment of the present invention.

A list of the reference numerals:

| | | |
|---|---|---|
| 1: Frame; | 2: Unwinding mechanism; | 3: Winding mechanism; |
| 4: Elavator mechanism of cutter heads; | | 41: Elevating motor; |
| 42: Second reducer; | 43: Screw rod; | 5: Revolving table; |
| 51: First table; | 52: Second table; | 6: Cutter heads; |
| 61: Sliding plate; | 62: Swing frame; | 63: Arc-shaped rail; |
| 64: Swing shaft; | 65: Servo motor; | 66: First reducer; |
| 67: Gear; | 68: Arc-shaped gear rack; | 69: Cutting assembly; |
| 691: Cutting roller; | 692: Roller driving motor; | 610: Winding assembly; |
| 7: Transition guide-wheel sets; | | |
| 8: Tension adjusting mechanism. | | |

DETAILED DESCRIPTION OF THE EMBODIMENT

The technical solution of the present disclosure will be clearly and fully described by way of embodiments below in conjunction with the accompanying drawings.

As shown in FIG. 1, the present disclosure provides a sapphire wafer squaring machine with double swing cutter heads, and the sapphire wafer squaring machine includes a frame 1, an unwinding mechanism 2, a winding mechanism 3, two cutter heads 6 placed at an angle of 90° between each other, an elevator mechanism 4 for the cutter heads and a revolving table 5.

The unwinding mechanism and the winding mechanism are arranged at both ends of the frame, respectively.

Two cutter heads are arranged within the frame.

The revolving table may be rotated by an angle of 90, 180, 270° or 360°. The revolving table includes a first table 51 and a second table 52, which are arranged below the above-mentioned two cutter heads, respectively.

The cutting center of each of the cutter heads is located at the circumference with a center which is the center of the corresponding dividing head of the revolving table. When the squaring machine is in use, a workpiece is fixed on each of the first table and the second table. The revolving table is rotated by an angle of 180° (i.e., the first table and the second table exchange positions with each other) after the cutter head above each of the first and second tables is moved down to complete a cutting process once, then the cutter heads are moved down again to complete a cutting process once again, thus these two workpieces are chamfered and the desired chamfers are obtained.

After finishing the cutting process of the workpieces, the workpiece on the second table may be removed when the revolving table is rotated by an angle of 90° clockwise, while the workpiece on the first table may be removed when the revolving table is rotated by an angle of 270° clockwise. As such, the workpiece is moved to the front of the squaring machine so as to facilitate the adjusting, loading and unloading of the workpiece.

The squaring machine of the present disclosure includes one control system, one control mechanism and two cutter heads, thereby reducing the overall cost of the squaring machine and enhancing the cutting efficiency of the squaring machine.

Figure 2:
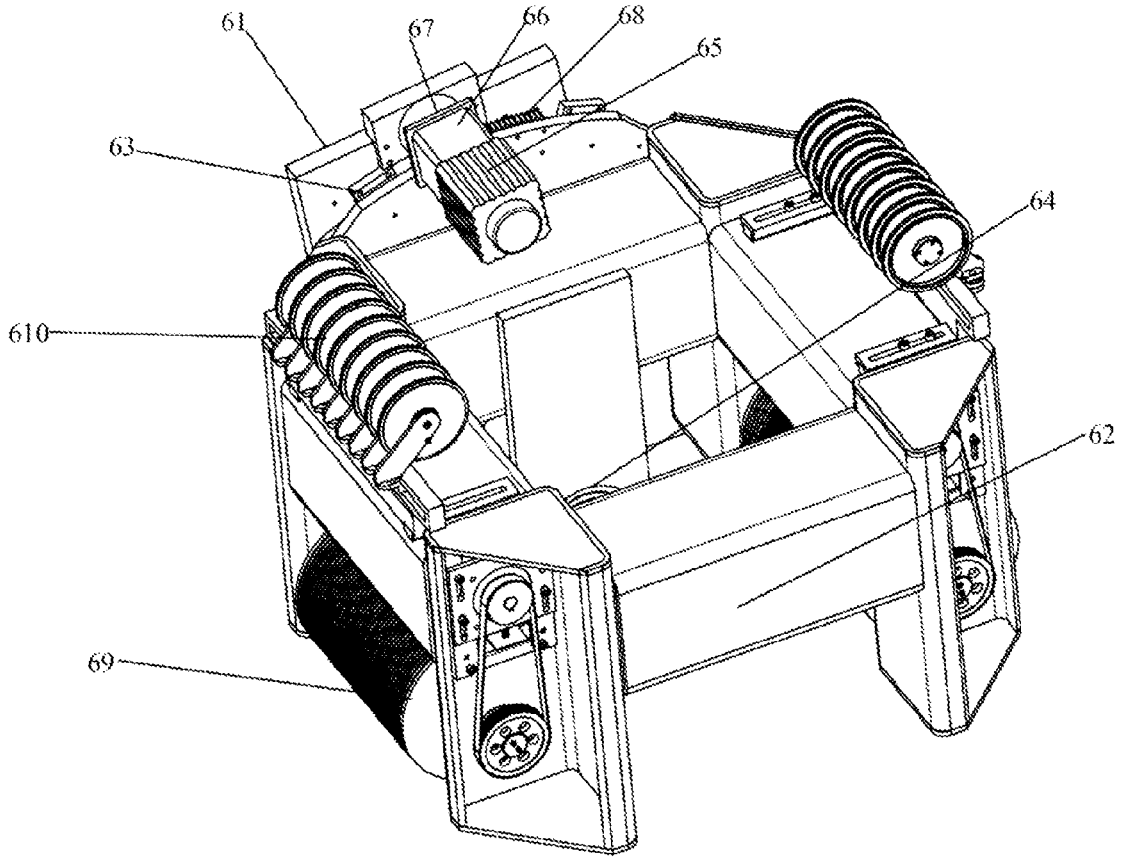
FIG. 2 is a schematic illustration of the structure of a cutter head according to the present invention.
Figure 3:
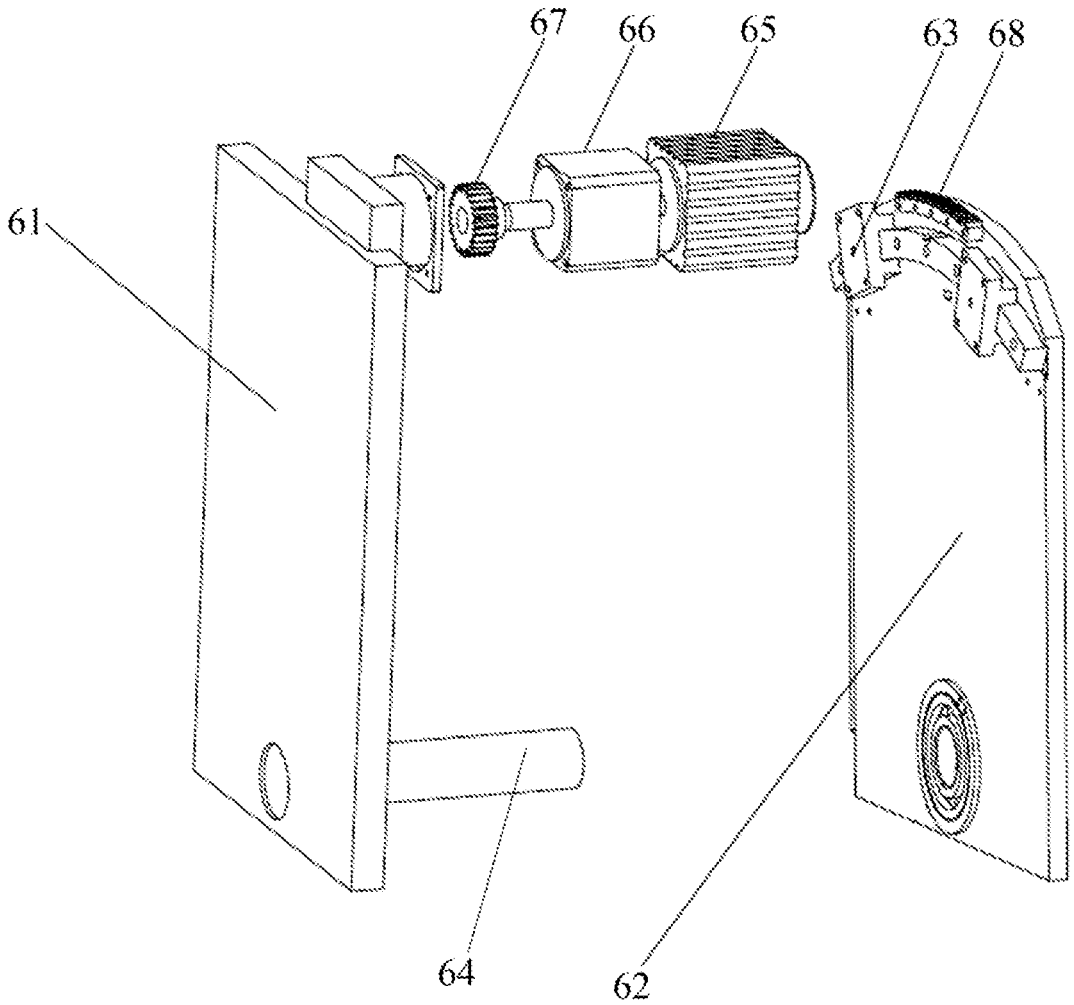
FIG. 3 is a partial exploded drawing of connection portion between a sliding plate and a swing frame.

As shown in FIGS. 2 and 3, the cutter head includes: a sliding plate 61 which is connected with the elevator mechanism for the cutter heads; and a swing frame 62 which is connected with the sliding plate 61 through an arc-shaped rail 63 arranged at the back of the swing frame and a swing shaft 64 arranged at the center of a circle along which the arc-shaped rail runs. A servo motor 65, a first reducer 66 and a gear 67 are arranged coaxially at the sliding plate. The swing frame is provided with an arc-shaped gear rack 68 which is configured to engage with teeth of the gear. The arc-shaped rail and the arc-shaped gear rack are located on concentric circles. In the process of cutting, the gear is driven to rotate by the servo motor, and the kinetic energy outputted by the servo motor is transferred to the swing frame through the engagement between the gear and the arc-shaped gear rack, thus the swing frame may be swung slightly around the swing shaft. The swing frame may be controlled to swing back and forth by changing the rotation direction of the servo motor.

Two cutting assemblies 69 are arranged at the bottom of the swing frame symmetrical to the swing shaft, and winding assemblies 610, which are wound openly, are arranged above the swing frame.

Figure 4:
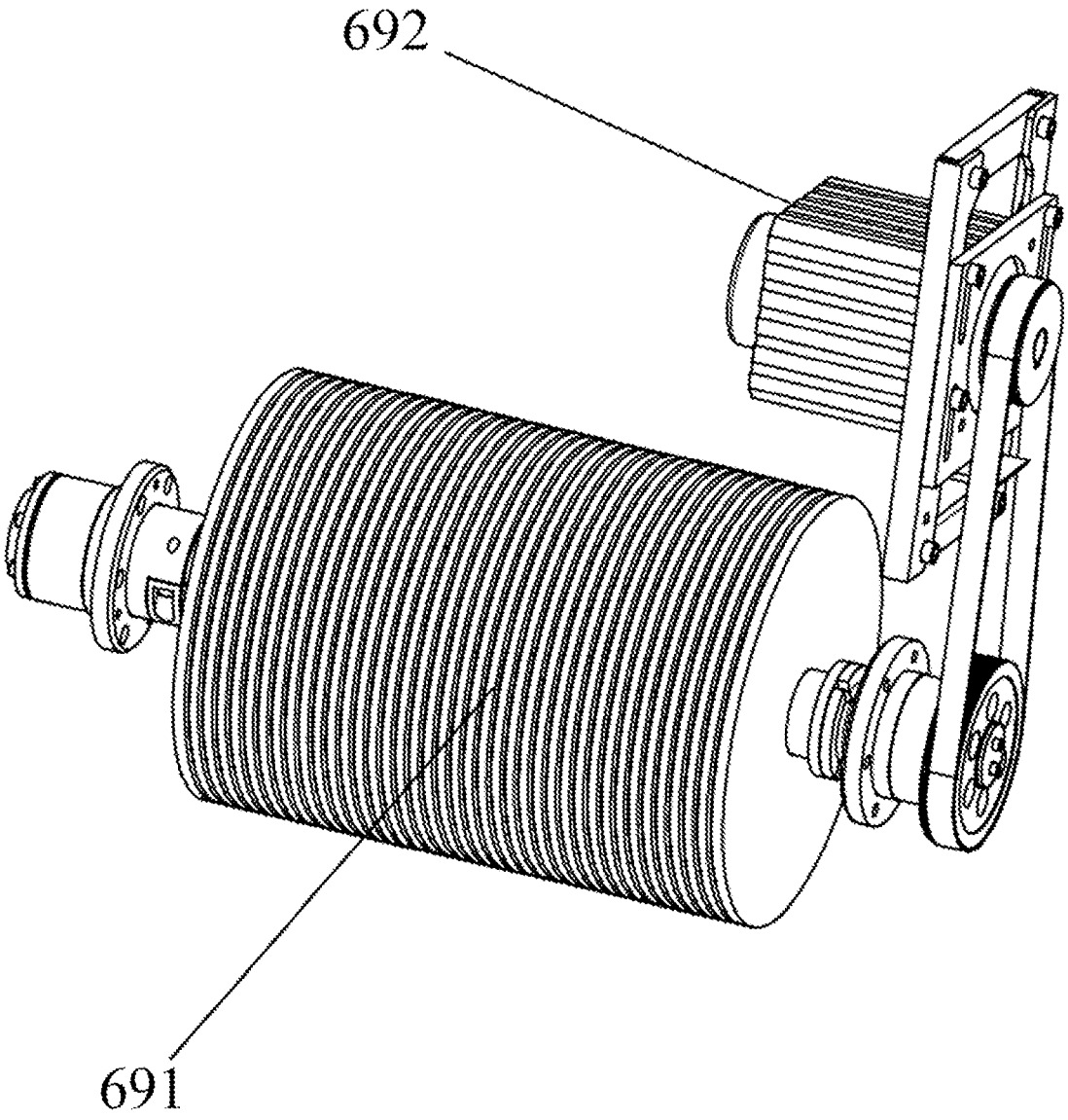
FIG. 4 is a schematic illustration of the structure of a cutting assembly according to the present invention.

As shown in FIG. 4, the cutting assembly includes a cutting roller 691 and a roller driving motor 692 which is configured to drive the cutting roller to rotate, and the transmission between the cutting roller 691 and the roller driving motor 692 is implemented through driving and driven wheels and a belt.

The winding assemblies include two parallel guide-wheel sets respectively arranged above those two cutting assemblies, and the axis of each of the parallel guide-wheel sets is parallel to that of the cutting roller of the corresponding cutting assembly.

The elevator mechanism for the cutter heads includes an elevating motor 41, a second reducer 42 and a screw rod 43 which are arranged from top to bottom successively. The screw rod is configured to engage with threads of a screw nut at the back of the sliding plate.

A transition guide-wheel set 7 and a tension adjusting mechanism 8 are arranged between the above two cutter heads. The transition guide-wheel set and the tension adjusting mechanism may control the tension at the incoming and outgoing fixed-diamond wire ends between the two cutter heads, ensuring the two cutter heads have the same cutting efficiency and effectively reducing the probability of wire breakage.

In another embodiment, the above two cutter heads are placed at an angle of 180° between each other, without other changes to the squaring machine compared with the embodiment described above.

In the sapphire wafer squaring machine with double swing cutter heads as provided according to the embodiments of the present invention, the cutter heads thereof may be swung slightly in the process of cutting, so that the contact area between the fixed-diamond wire and the workpiece under cutting is reduced greatly due to the swing compared with the case where the cutter heads are fixed, thus enhancing the pressure per unit area and the cutting efficiency. Further, the cutter heads are arranged above the workpieces, so that it is easy to load and/or unload the workpieces, and the fixed-diamond wires may be fed from top to bottom in cutting. The fixed-diamond wires are wound openly (that is, the fixed-diamond wires are uncovered) in the cutter head for the purpose of easy wiring, and the space between the fixed-diamond wires in the cutter heads may be as small as 25 mm so that the minimum square product with a size of 25 mm×25 mm may be obtained by the cutting through the squaring machine. In addition, the fixed-diamond wires of both the cutter heads simultaneously come into contact with the workpieces for cutting, thus there is no idling and waiting time for the cutter heads, thus shortening the cutting time.

The present disclosure can be embodied or used by those skilled in the art in light of the above description of the sapphire wafer squaring machine with double swing cutter heads according to the disclosed embodiments. It is obvious for those skilled in the art that various modifications can be made for the embodiments. The general principles defined in the present disclosure can be achieved in the other embodiments without departing from the spirits or the scope of the present disclosure. Therefore, the present disclosure is not limited to the exemplary embodiments, but conforms to a broader scope consistent with the disclosed principles and novelty.

The invention claimed is:

1. A sapphire wafer squaring machine with double swing cutter heads, comprising a frame, wherein, the sapphire wafer squaring machine further comprises an unwinding mechanism, a winding mechanism, two cutter heads placed at an angle of 90° or 180° between each other, an elevator mechanism for the cutter heads and a revolving table;

the unwinding mechanism and the winding mechanism are arranged at both ends of the frame, respectively;

the two cutter heads are arranged within the frame;

the revolving table is rotatable by an angle of 90°, 180°, 270° or 360°, and comprises a first table and a second table, which are arranged below the two cutter heads, respectively;

each of the cutter head comprises: a sliding plate which is connected with the elevator mechanism for the cutter heads; and a swing frame which is connected with the sliding plate through an arc-shaped rail arranged on the swing frame and a swing shaft arranged at a center of a circle along which the arc-shaped rail runs; a servo motor, a first reducer and a gear are arranged coaxially at the sliding plate, and the swing frame is provided with an arc-shaped gear rack which is configured to engage with teeth of the gear;

two cutting assemblies are arranged at the bottom of the swing frame symmetrical to the swing shaft, and winding assemblies are arranged above the swing frame.

2. The sapphire wafer squaring machine with double swing cutter heads of claim 1, wherein, the cutting assembly comprises a cutting roller and a roller driving motor, and transmission between the cutting roller and the roller driving motor is implemented through driving and driven wheels and a belt.

3. The sapphire wafer squaring machine with double swing cutter heads of claim 2, wherein, the winding assemblies comprise two parallel guide-wheel sets respectively arranged above the two cutting assemblies, and the axis of each of the parallel guide-wheel sets is parallel to that of the cutting roller of the corresponding cutting assembly.

4. The sapphire wafer squaring machine with double swing cutter heads of claim 1, wherein, the elevator mechanism for the cutter heads comprises an elevating motor, a second reducer and a screw rod which are arranged from top to bottom successively.

5. The sapphire wafer squaring machine with double swing cutter heads of claim 1, wherein, a transition guide-wheel set and a tension adjusting mechanism are arranged between the two cutter heads.

* * * * *